US007465861B2

(12) United States Patent
Passafiume

(10) Patent No.: US 7,465,861 B2
(45) Date of Patent: Dec. 16, 2008

(54) RIM FOR A BANJO

(75) Inventor: Anthony Passafiume, Louann, AR (US)

(73) Assignee: Tony Pass Banjo Rim, LLC, Louann, AR (US)

( * ) Notice: Subject to any disclaimer, the term of this patent is extended or adjusted under 35 U.S.C. 154(b) by 428 days.

(21) Appl. No.: 10/819,623

(22) Filed: Apr. 7, 2004

(65) Prior Publication Data

US 2005/0223870 A1 Oct. 13, 2005

(51) Int. Cl.
*G10D 13/02* (2006.01)

(52) U.S. Cl. ..... 84/411 R

(58) Field of Classification Search ..... 84/411 R, 84/421, 419, 420

See application file for complete search history.

(56) References Cited

U.S. PATENT DOCUMENTS 3,677,125 A * 7/1972 Oliver ..... 84/271
3,921,492 A * 11/1975 Stelling ..... 84/269
4,213,368 A 7/1980 Cox
4,226,159 A 10/1980 Lowe
4,852,446 A 8/1989 Kennedy
2002/0134215 A1 9/2002 Spradlin, Sr.

* cited by examiner

*Primary Examiner*—Kimberly R Lockett
(74) *Attorney, Agent, or Firm*—Greer, Burns & Crain, Ltd

(57) ABSTRACT

A rim of the type used in a resonator banjo having a body that includes a head, a resonator, a tone ring and a flange for securing the head and the tone ring to the banjo, where the rim includes a generally circular housing having an inner circumference and an outer circumference, a top end and a bottom end, wherein the top end is configured to engage the tone ring, an annular shoulder portion extending around the outer circumference for engaging the flange, and an arcuate recess located below the top end and extending along at least a portion of the inner circumference.

22 Claims, 7 Drawing Sheets

RIM FOR A BANJO

BACKGROUND OF THE INVENTION

The modern banjo includes a plurality of models, which includes the four-string version (plectrum and tenor), five-string versions, and even six-string versions. The sound produced by a banjo is characterized by poorly sustained notes that are preferably deep and rich. As a musical instrument, the banjo is unusually amenable to modifications. For example, a player may tighten or change the head, which is the stretched membrane disposed beneath the strings to amplify the sound of the strings when played. Additionally, heavier or lighter bridges may be used, or the strings may be changed from nylon to steel for example.

A resonator banjo, which is the type normally used for bluegrass music, has a body that includes a head, a tone ring and a rim. Typically, the head is a membrane that is stretched across the generally circular tone ring, which in turn rests upon and is connected to the rim, which is normally made of wood. On an external circumference of the body, there is a supporting device called a "resonator flange," which promotes centering of the rim and suspension of the rim at least partially inside the resonator. The resonator of a resonator banjo consists of a generally rounded back section and a circular side wall.

A cavity within the body of the banjo and the resonator is called an "air chamber." The air chamber communicates to an outside of the banjo at a bottom portion of the rim. In most cases, the bottom portion of the rim generally does not contact the resonator. The volume of the air chamber is determinative of some of the frequency and amplitude characteristics of the banjo.

Conventional methods of adjusting the volume of the air chamber within the banjo included moving the resonator with respect to the rim and/or the head of the banjo. For example, moving the resonator farther away from the rim and/or the head increases the volume of the air chamber. Over the years, banjo players and luthiers that specialize in the banjo have determined that each individual instrument has an optimum air chamber volume, which generally must be determined according to the individual components of each individual banjo because each instrument may have different vibrational characteristics. The difficulty posed by this method is that in many cases, the resonator mounting loses stability, which can cause mechanical problems with the banjo.

SUMMARY OF THE INVENTION

Embodiments of the instant invention comprise a rim that has at least a portion with an increased inner diameter.

DETAILED DESCRIPTION OF THE INVENTION

Figure 1:
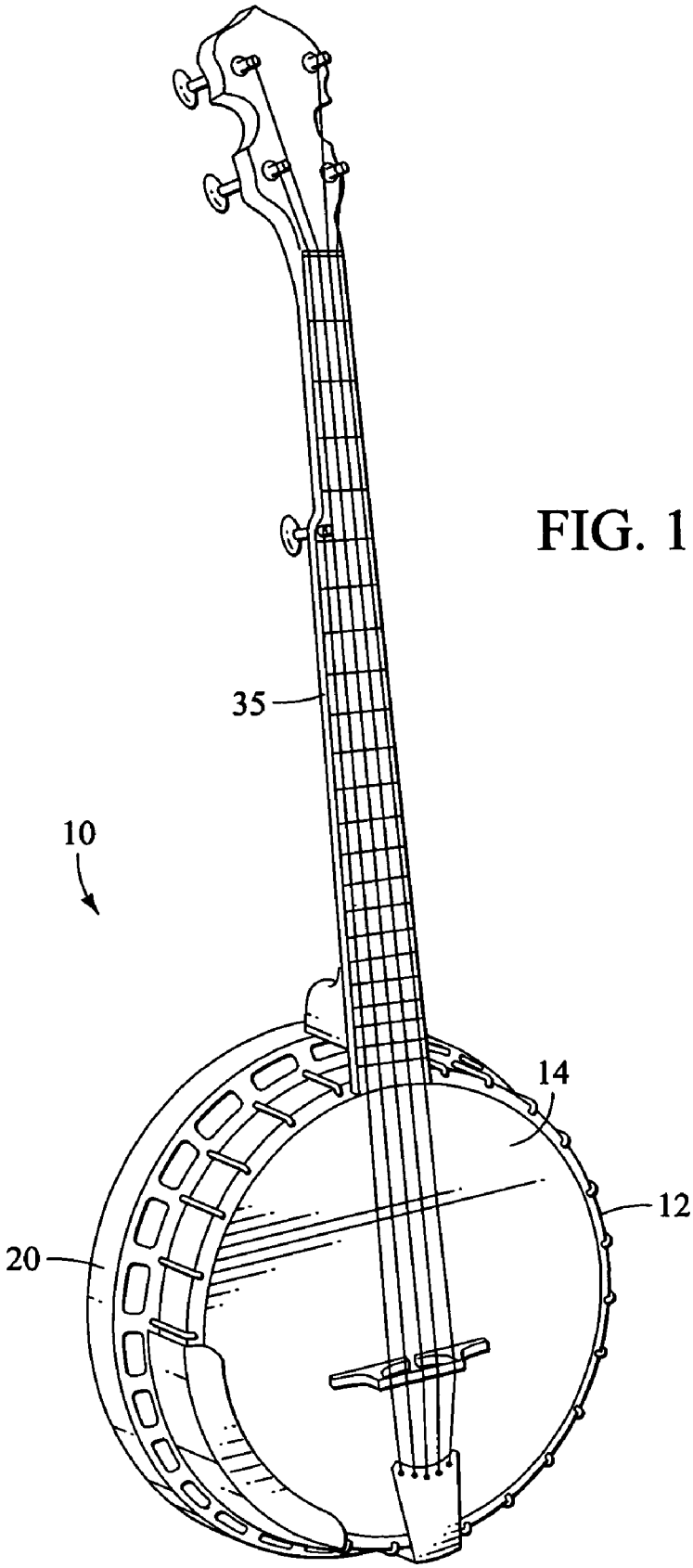
FIG. 1 is a front perspective view of a resonator banjo of the type used with one or more embodiments of the rim of the instant invention.
Figure 2:
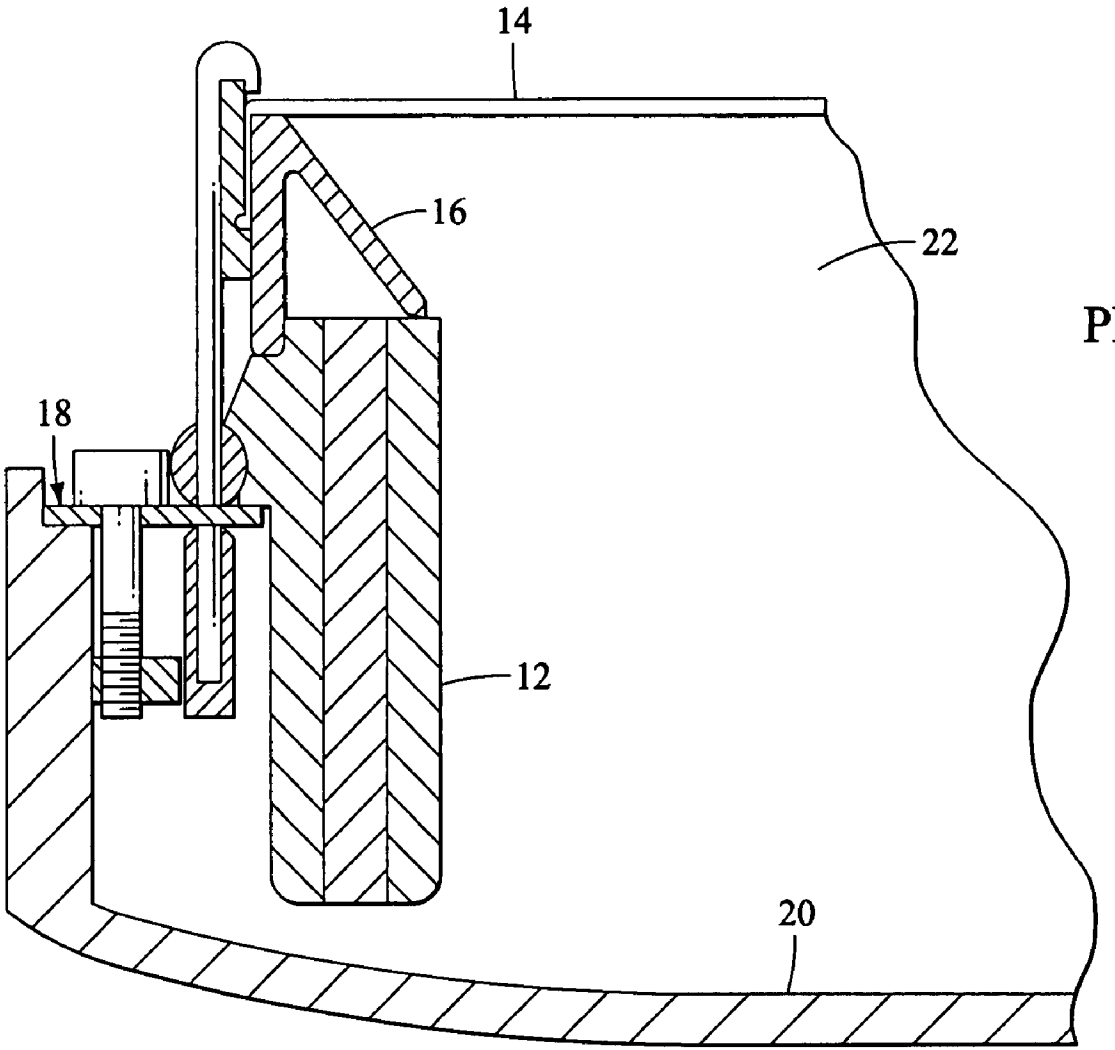
FIG. 2 PRIOR ART
FIG. 2 is a side schematic view of the resonator banjo illustrated in FIG. 1 in combination with a conventional rim.

While the modified banjo rim of the instant invention may be used with a variety of instruments, for purposes of illustration, a resonator banjo will be shown and discussed. Turning therefore to FIGS. 1 and 2, a typical resonator banjo, designated generally at 10, is illustrated with a conventional, unmodified rim 12. The resonator banjo 10, which is the type normally used for bluegrass music, has a body that includes of a head 14, a tone ring 16 (best shown in FIG. 2), and the rim 12. Typically, the head 14 is a membrane made from goatskin or mylar that is stretched across the generally circular tone ring 16, and which in turn rests upon and is connected to the rim 12, which is normally made of wood. On an external circumference of the body, there is a supporting device called a resonator flange 18 (best shown in FIG. 2), which is coupled to the rim via a shoulder portion 19 and promotes centering of the rim 12 and suspension of the rim at least partially inside of a resonator 20. The resonator 20 of the resonator banjo 10 consists of a generally rounded back section and a circular side wall, and functions to reflect sound forward of the body.

Figure 3:
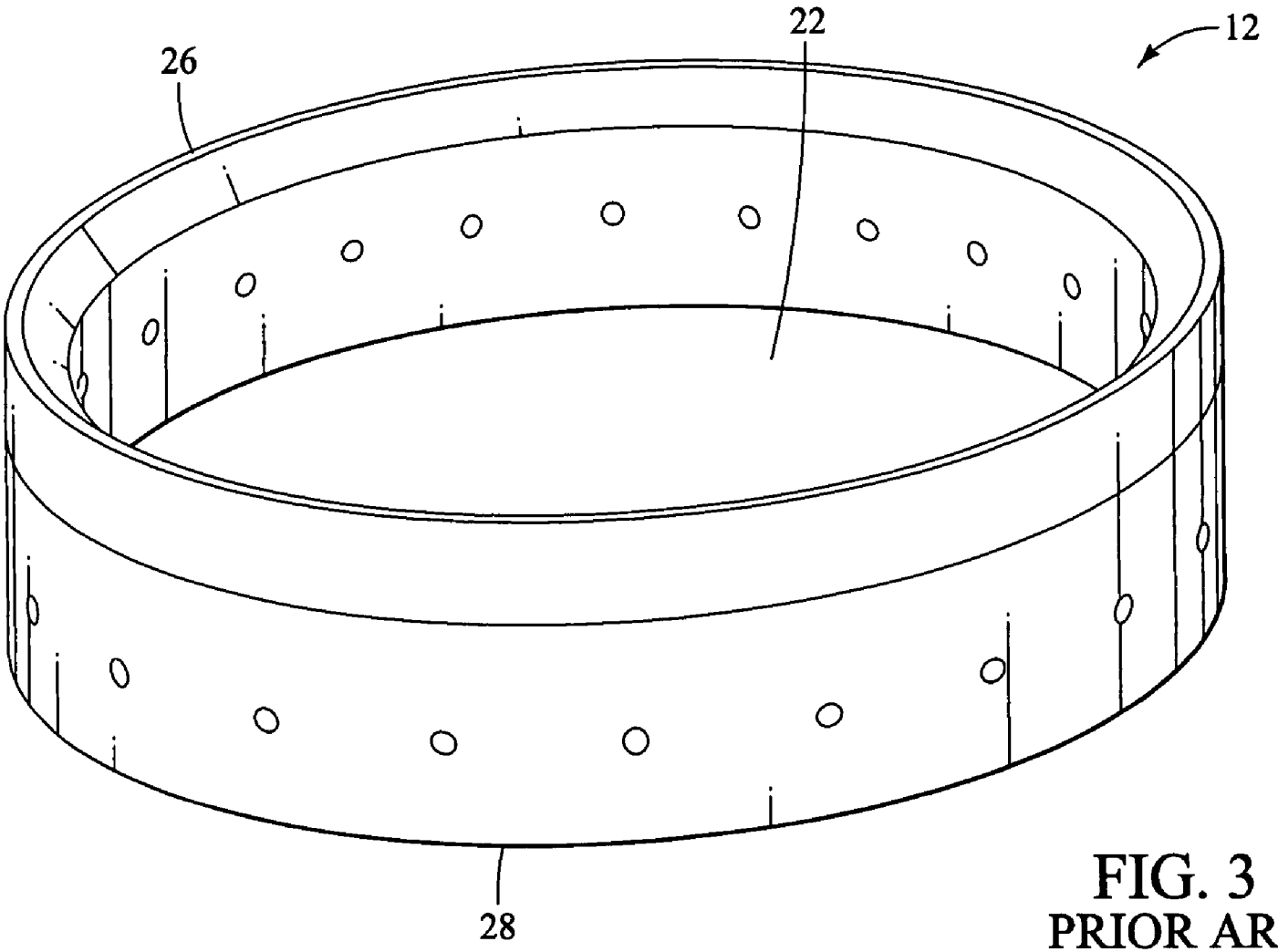
FIG. 3 PRIOR ART
FIG. 3 is a side perspective view of a conventional rim.
Figure 4:
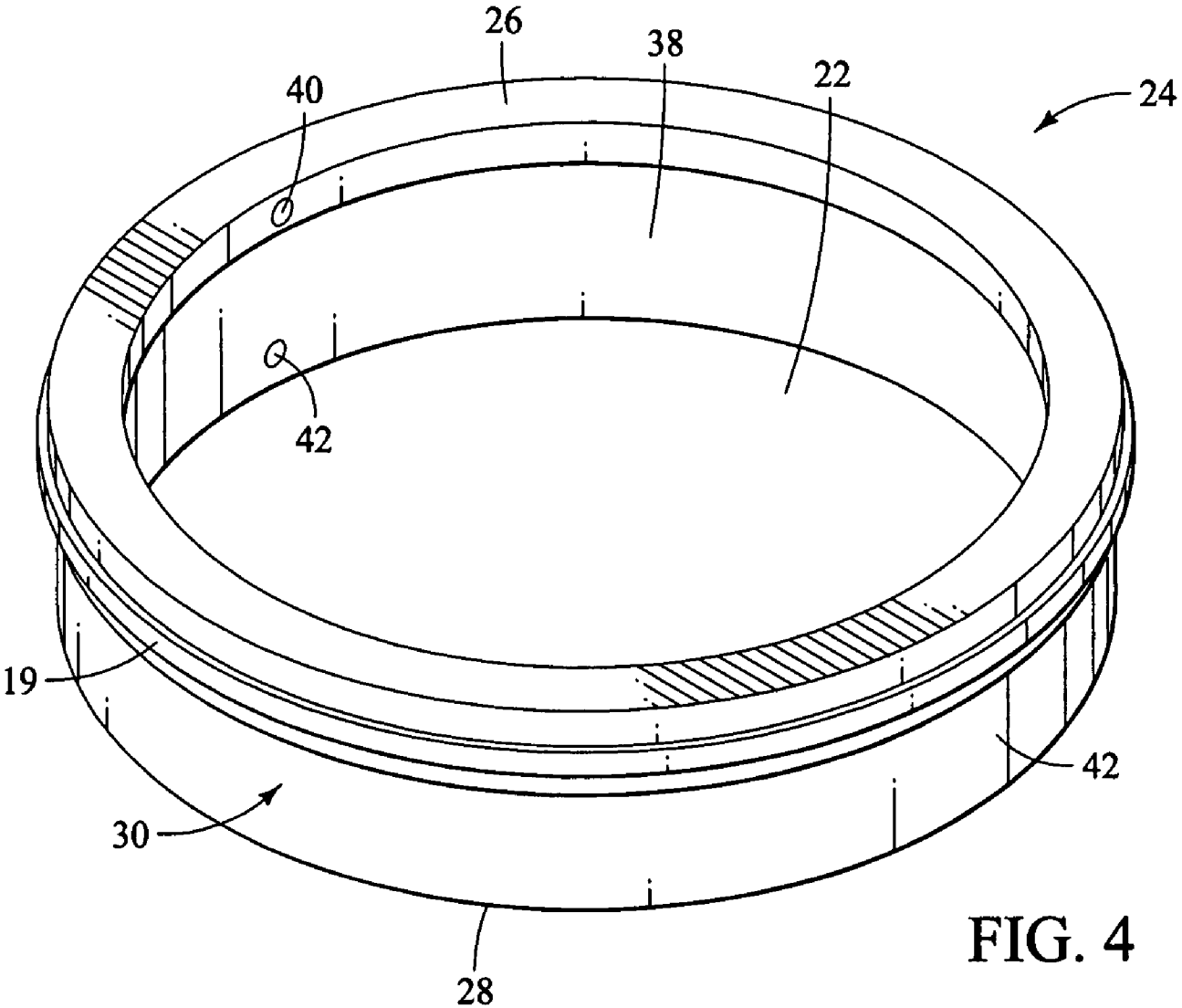
FIG. 4 is a side perspective view of a preferred embodiment of the modified rim of the instant invention.

As illustrated in FIGS. 2, 3 and 4, the conventional rim 12 includes a predetermined inner diameter of the rim that is uniform throughout a height of the rim. Conventional measurements for the inner diameter of a "Gibson-style" rim 12 (FIGS. 7B-7E) are approximately 9.5 inches, with tolerances of plus or minus 1/16 of an inch, while an "Old Style Stelling" rim (FIG. 7A) includes an inner diameter of approximately 9.2 inches, with tolerances of plus or minus 1/16 of an inch, while a more modern "Stelling-style" includes an inner diameter of approximately 9.5 inches, with tolerances of plus or minus 1/16 of an inch. A cavity within the body of the banjo 10 and the resonator 20 is an air chamber 22, which communicates to an outside of the banjo 10 at a bottom portion of the rim 12. In most cases, the bottom portion of the rim 12 generally does not contact the resonator 20. A volume of the air chamber 22 is determinative of some of the frequency and amplitude characteristics of the banjo 10. An increase in the volume of the air chamber 22 is often desirable in that the greater the volume of the air chamber, typically the deeper and richer tone of the banjo 10.

Accordingly, the instant invention provides for a predetermined increase in the volume of the air chamber 22 wherein frequency and amplitude characteristics of the banjo 10 may be selectively varied. In a preferred embodiment, the volume of the air chamber 22 is increased by increasing at least a portion of an inner diameter of the rim 12, which results in, among other things, a tuning of the rim to achieve a better bass response.

More specifically, turning now to FIG. 4, which illustrates a preferred embodiment modified rim 24 of the instant invention, the preferred rim is a generally circular, ring-shaped structure composed of a predetermined type of wood, such as maple, beech, birch, mesquite, mahogany, walnut, cherry, sycamore, spruce, rosewood, purpleheart, ebony or any other such wood desired by the manufacturer or the musician. Like the conventional rim 12, the modified rim 24 of the instant invention may be used with a resonator banjo 10, wherein the modified rim engages the head 14, the tone ring 16 and the resonator flange 18, which promotes centering of the rim 12 and suspension of the rim at least partially inside of the resonator 20. However, the modified rim 24 of the instant invention provides for a tuning of the rim that results in an increased volume of the air chamber 22 disposed within the rim.

The modified rim 24 of the instant invention illustrated in FIG. 4 preferably includes a non-uniform inner diameter along a height thereof, resulting in a non-uniform inner diameter. While the modifications resulting in the modified rim 24 of the instant invention may be performed on conventional rims 12 having inner diameters measuring approximately 9.5 inches, it is anticipated that the modifications discussed herein may be used in connection with the conventional rim 12 having any predetermined inner diameter, such that the modifications increase the volume of air chamber 22 with an increase in the inner diameter of at least a portion of the conventional rim.

More specifically, the preferred rim 24 of the instant invention includes a top rim surface 26 and a bottom rim surface 28, with a rim body 30 spanning therebetween. The rim body 30 includes initial thickness that, as discussed, results in a uniform inner diameter of approximately 9.5 inches. While the inner circumference and inner diameter are generally uniform, the outer circumference of a conventional rim may have both a variable outer diameter and a variable outer circumference, depending on the model of the particular rim. For example, turning to FIG. 5B, where the conventional rim 12 is configured to engage a two piece flange 18, the outer circumference and outer diameter are generally uniform along the rim body 30, except for the circumference as measured around the resonator flange 18. In contrast, other conventional rims 12, as illustrated in FIGS. 5A, 5C, and SD are configured to engage a one piece flange 18 and have outer circumferences and outer diameter measurements that may vary along a height of the rim body 30, typically where upper portions of the rim body 30 have a larger outer circumference than that of a lower portion of the rim body.

Figure 6:
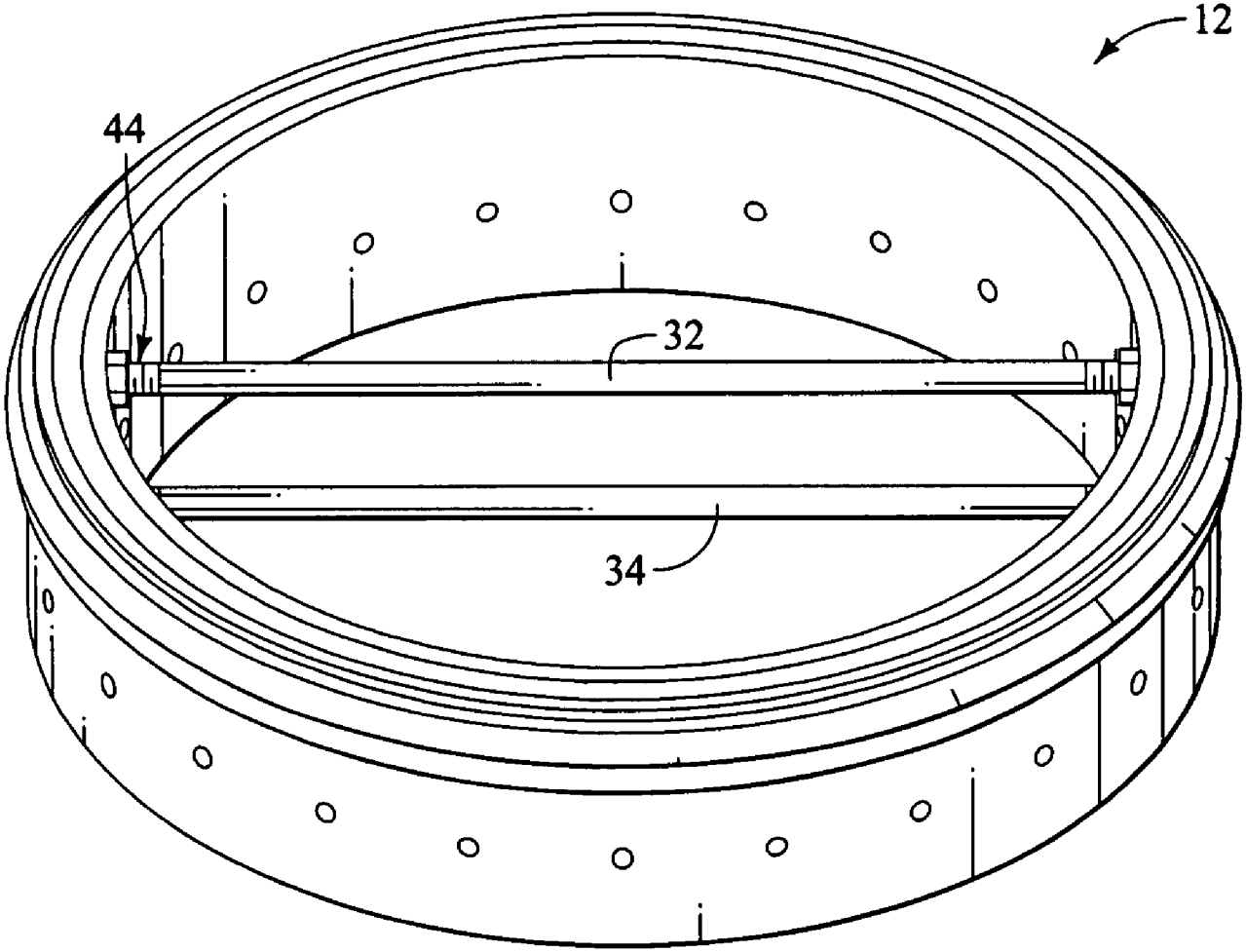
FIG. 6 PRIOR ART
FIG. 6 is a side perspective view of a conventional rim having upper and lower coordinator rods.

Turning to FIG. 6, in the conventional resonator banjo 10 upper and lower coordinator rods 32, 34 span the inner diameter of the rim 12, wherein the upper coordinator rod 32 is disposed closer to the top rim surface 26 while the lower coordinator rod 34 is disposed closer to the bottom rim surface 28. These coordinator rods 32, 34 are used to adjust the action and keep a neck 35 (best shown in FIG. 1) of the banjo 10 aligned. Preferably, the modified rim 24 of the instant invention includes an inner diameter that is at least slightly smaller toward the bottom rim surface 28 than an inner diameter that is disposed toward a top rim surface 30, thus increasing the volume of the air chamber 22 encompassed by the rim 24.

For purposes of discussion, a portion of the rim body 30 disposed between the resonator flange 18 and the bottom rim surface 28 is defined as a rim skirt, while the remaining portion above the rim skirt is defined as the top portion. A thickness of conventional rims 12 may be generally uniform or may vary along the height of the rim body 30. Thus, portions of the rim body 30 toward the top rim surface 26 may have different circumference and different outer diameter measurements than portions of the rim body toward the bottom rim surface 28, or conversely, the outer circumferences and outer diameter measurements of the two portions may be the same. The modifications of the instant invention may be made to any conventional rim, irrespective of relative outer diameter measurements or outer circumference measurements, because the modified rim 24 of the instant invention includes an alteration to the inner diameter of a rim.

Figure 5A:
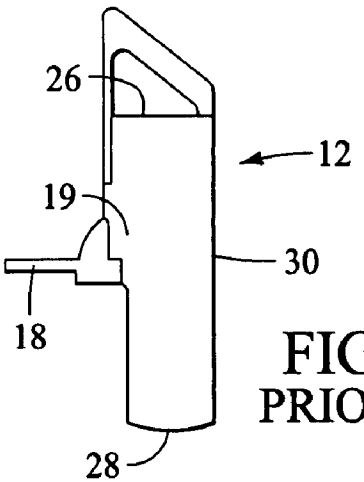
FIG. 5A PRIOR ART
FIGS. 5A-5D are cross sectional views of conventional rims, each having a flange and a tone ring engaged thereto.
Figure 5B:
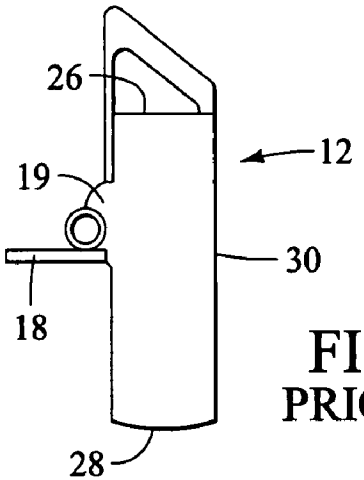
FIG. 5B PRIOR ART
Figure 5C:
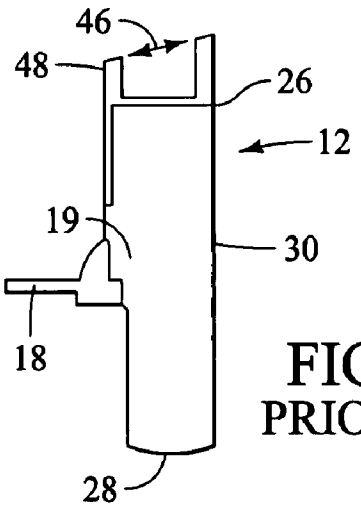
FIG. 5C PRIOR ART
Figure 5D:
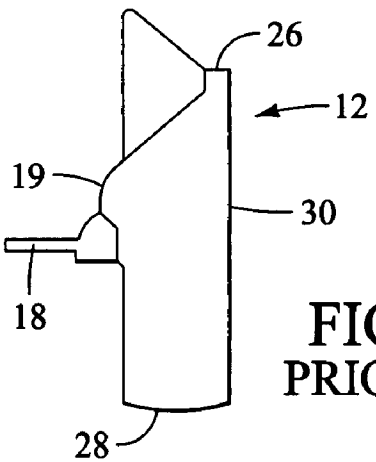
FIG. 5D PRIOR ART
Figure 7C:
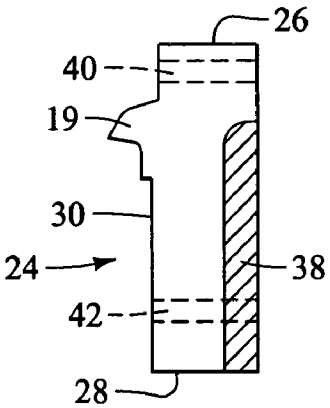
FIGS. 7A-7E illustrate cross-sectional views of modified rims according to embodiments of the instant invention.
Figure 7B:
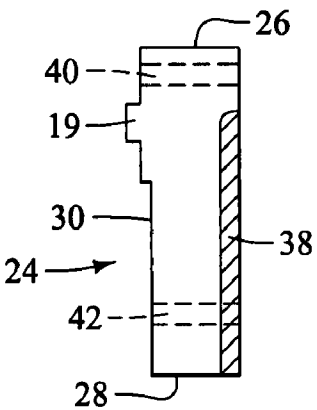
Figure 7A:
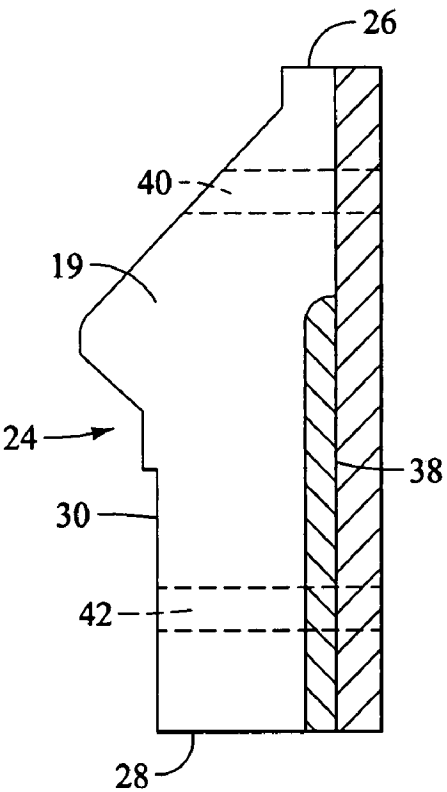
Figure 7E:
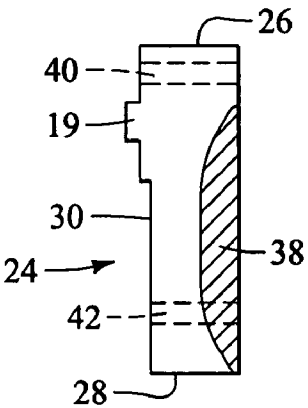
Figure 7D:
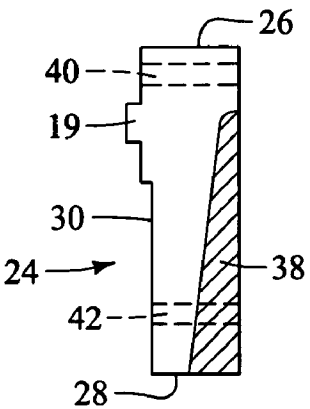

For example, the modified rim 24 of the instant invention may be configured from the conventional 12 rim having the two-piece flange 18 illustrated in FIG. 5B, or the conventional rim having the one-piece flange illustrated in FIGS. 5A, 5C and 5D. An arcuate groove 38 is preferably provided at a predetermined point that is preferably below the upper coordinator rod 32 and extends downwardly for a predetermined distance toward the bottom rim surface 28, and extends around an inner circumference for a predetermined length as well. In FIGS. 7A-7E, the arcuate groove 38 extends downwardly from predetermined point below the upper coordinator rod 32 to the bottom rim surface 28, and extends around an inner circumference of the rim 24 for a full 360°. While the instant invention contemplates a plurality of cross-sectional shapes for the arcuate groove 38, a cross-sectional shape of the arcuate recess in FIGS. 7A-7C is generally rectangular, having a generally uniform inner diameter along a height of the arcuate groove.

The arcuate groove 38 of the instant invention may assume a plurality of configurations, depending on the desired increase in volume of the air chamber 22, on the degree to which the rim 24 is desired to be thinned, or other considerations such as aesthetics. For example, as illustrated in FIGS. 7A-7E, the cross-sectional shape of the arcuate groove 38 may be rounded, triangular, or even amorphous in shape, or may have a variable depth. Preferably, however, the cross-sectional shape provides a uniform inner diameter along a height of the arcuate groove 38 such that the bottom coordinator rod 30 may be securely fastened thereto. Typically, the upper and lower coordinator rods 32, 34 engage corresponding openings 40, 42 in the inner circumference of the rim 12, 24, and are lockingly maintained using a nut assembly 44. Accordingly, the preferred uniform inner diameter along the height of the arcuate groove 38 provides a uniform surface for abutment of an underside of the nut assembly 44. However, non-uniform inner diameters are contemplated by the instant invention as well.

Similarly, the predetermined distance by which the arcuate groove 38 extends downwardly from the predetermined point that is preferably below the upper coordinator rod 32 may vary greatly as well. The arcuate groove may extend all of the way to the bottom rim surface 28, or may extend some predetermined distance falling short of the bottom rim surface. Preferably, the arcuate groove 38 extends downwardly from a predetermined point below the upper coordinator rod 32 to a predetermined point below the lower coordinator rod 34 so that the nut assembly 44 will have a uniform surface to abut.

While the instant invention explicitly contemplates extending the arcuate groove 38 above the upper coordinator rod 32, the preferred embodiment arcuate groove does not extend above the upper coordinator rod. Instead, the preferred embodiment of the instant invention includes an upper rim body 30 that maintains a standard inner diameter so that it may better engage standard a standard tone ring. The tone ring 16 is a generally circular structure that engages a top of the rim 24 to impart a clear ringing tone to the banjo 10, and while the engagement of the tone ring to the rim is dependent on both the type of tone ring and the type of rim, typically, the tone ring engages the rim at the outer circumference of the rim and at or near the inner circumference of the rim.

More particularly, there are a plurality of different styles of tone ring 16, and the instant invention is contemplated for use with any one of them. The most popular style of tone ring 16 is the "flathead" configuration illustrated in FIGS. 5A, 5B and 5D, wherein the head 14 stretched atop the tone ring appears flat all of the way to the edge. Another style is the "archtop" or "raised head," which is illustrated in FIG. 5C and includes an inner raised portion 46 over which the head 14 makes a bend downward toward an outer edge 48 of the tone ring 16. Because of the bend, the vibrating surface of the head 14 is approximately 1½ inches less in diameter than is the "flathead," which makes the banjo 10 in which the "archtop" tone ring 16 is disposed have a relatively higher natural pitch. The banjo 10 incorporating an "archtop" tone ring 16 has greater power in the high registers, and less strength in the bass region, have less sustain and a more percussive tone.

Typically, as illustrated in FIGS. 5A-5D, the various tone rings 16 are configured to engage either the "Gibson-style" rim 12 (FIGS. 5A-5C) or the "Stelling-style" rim (FIG. 5D) at or near the outer circumference of the rim, and at or near the inner circumference of the rim. Accordingly, while the instant invention provides for an increased inner diameter within a portion of the rim 24, the instant invention also contemplates that other portions of the rim will remain unchanged such that conventional engagement between the tone ring 16 and either the "Gibson-style" or "Stelling-style" rim will remain unaffected while at the same time, the volume of the air chamber 22 is increased.

In addition to increasing the volume of the air chamber 22, the modifications of the modified rim 24 alter the sound emitted by the banjo 10 with which it is used because by removing a portion of the inner circumference of the rim, a thickness of that portion of the rim is necessarily reduced. This is what is known as a "thin skirt" rim, though strictly speaking, it may be that only portions of the rim skirt are thinned by the instant modifications, or that portions of the rim body 30 in addition to the rim skirt are thinned. In this manner, the rim is tuned according to the specifications of a manufacturer or a musician.

A difference in rim thicknesses will produce air chambers 22 of different volumes, where typically air chambers having a larger volume resonate with a lower pitched sound. This result may also be attributed to the greater flexibility of the thinned rim skirt of the modified rim 24. The sound obtained by implementing the modifications of the instant invention, that is, increasing the inner diameter of the rim 24, are similar to those obtained by moving the resonator 20 away from the rim and/or the head 14 of the banjo 10 a proportional amount. Some banjos sound better with rims that have a thinner skirt than others, so a particular thickness of a particular rim that works well on one instrument is not necessarily the thickness that will work best on another instrument. The instant invention is therefore particularly advantageous in that the modifications may be customized for a particular instrument, depending on the acoustics inherent to the rim and the acoustics desired by the manufacturer or musician.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention.

What is claimed is:

1. A rim of the type used in a resonator banjo having a body that includes a head, a resonator, a tone ring and a flange for securing the head and the tone ring to the banjo, said rim comprising:

a generally circular housing having an inside wall defining an inner circumference and an outside wall defining an outer circumference;

a top end and a bottom end, wherein said top end has a flat top surface that interfaces said inside wall, said inner circumference of said inside wall adjacent said interface being the minimum circumference of said housing, said top surface being configured to engage the tone ring;

an annular shoulder portion provided on said outside wall for engaging the flange; and an arcuate recess in said inside wall located below said top end and extending along at least a portion of said inner circumference.

2. The rim of claim 1 wherein the tone ring is configured to engage said outside wall and said flat top surface adjacent said inside wall.

3. The rim of claim 1 wherein said top end has a first predetermined thickness between said inside and outside walls that is at least slightly greater than a second predetermined thickness of said bottom end.

4. The rim of claim 1 wherein an inner diameter at said top end is at least slightly smaller than a predetermined diameter at said bottom end.

5. The rim of claim 1 wherein said arcuate recess extends for 360 degrees along said internal circumference.

6. The rim of claim 1 wherein said inner circumference is configured to engage an upper and a lower coordinator rod that each span a diameter of said rim.

7. The rim of claim 6 wherein said arcuate recess has a predetermined height extending from a point below the upper coordinator rod to said bottom end.

8. A rim of the type for use in a resonator banjo that has a body that includes a head, a resonator, a tone ring and a flange for securing the head and the tone ring to the banjo, said rim comprising:

a wooden tone ring having an inner and an outer circumference;

a top end and a bottom end wherein said top end wherein said top end is configured to engage the tone ring; and wherein said top end includes an inner diameter that is at least slightly smaller than an inner diameter of said bottom end.

9. The rim of claim 8 wherein said top end is configured to engage the tone ring along said outer circumference and along a predetermined portion of said top end.

10. The rim of claim 8 wherein said top end is configured to engage the tone ring along said outer circumference and along the inner circumference.

11. The rim of claim 8 wherein said top end is configured to have a predetermined width so that the tone ring contacts said top end at a point on said outer circumference and at a point on said inner circumference.

12. The rim of claim 8 wherein said inner circumference is configured to engage an upper coordinator rod toward said top end and a bottom coordinator rod toward said bottom end.

13. The rim of claim 12 further comprising an arcuate groove that extends along at least a portion of said inner circumference.

14. The rim of claim 13 wherein said arcuate groove extends along said inner circumference for 360 degrees.

15. The rim of claim 13 wherein said arcuate groove extends downwardly from a point beneath said top end.

16. The rim of claim 13 wherein said arcuate groove has a predetermined height that extends from a point beneath the upper coordinator rod to said bottom end.

17. The rim of claim 13 wherein said arcuate groove has a generally rectangular cross section.

18. The rim of claim 13 wherein said arcuate groove has a generally rounded cross section.

19. The rim of claim 13 wherein said arcuate groove has a generally uniform depth.

20. The rim of claim 13 wherein said arcuate groove has a variable depth.

21. A method of increasing the volume of sound chamber for a resonator banjo comprising:

providing a generally circular tone ring having a generally flat top surface, an inside surface and an outside surface, said rim defining a circumference of the sound chamber, wherein said generally flat top surface extends from said inside surface outwardly toward the outside surface, said inside surface immediately adjacent to said top surface defining the minimum inside diameter of said tone ring;

increasing an inner diameter of a lower portion of the tone ring.

22. The method of claim 20 further comprising decreasing a thickness of the lower portion of the rim.

* * * * *